US005201295A

United States Patent [19]

Kimberley et al.

[11] Patent Number: 5,201,295

[45] Date of Patent: Apr. 13, 1993

[54] HIGH PRESSURE FUEL INJECTION SYSTEM

[75] Inventors: John A. Kimberley, East Granby, Conn.; John B. Cavanaugh, W. Springfield, Mass.

[73] Assignee: AIL Corporation, Columbia, S.C.

[21] Appl. No.: 686,830

[22] Filed: Apr. 17, 1991

Related U.S. Application Data

[63] Continuation-in-part of Ser. No. 478,199, Feb. 7, 1990, which is a continuation-in-part of Ser. No. 271,111, Nov. 14, 1988, abandoned, which is a continuation-in-part of Ser. No. 891,933, Jul. 30, 1986, abandoned.

[51] Int. Cl.[5] ..... F02M 39/00

[52] U.S. Cl. ..... 123/467; 123/447

[58] Field of Search ..... 123/467, 447, 500, 501, 123/446

[56] References Cited

U.S. PATENT DOCUMENTS

| | | | |
|---|---|---|---|
| 2,253,454 | 8/1941 | Vott | 123/387 |
| 2,398,878 | 4/1946 | Bolli | 123/287 |
| 2,890,657 | 6/1959 | May et al. | 103/41 |
| 3,332,408 | 7/1967 | Scott | 123/393 |
| 3,416,506 | 12/1968 | Steiger | 123/447 |
| 3,851,635 | 12/1974 | Murtin et al. | 123/139 E |
| 4,036,192 | 4/1977 | Nakayama | 123/467 |
| 4,080,942 | 3/1978 | Vincent | 123/447 |
| 4,211,202 | 7/1980 | Hafner | 120/467 |
| 4,258,674 | 3/1981 | Wolff | 123/446 |
| 4,359,032 | 11/1982 | Ohie | 123/467 |
| 4,403,585 | 9/1983 | Ohie | 123/446 |
| 4,421,088 | 12/1983 | Seilly | 123/447 |
| 4,440,135 | 4/1984 | Asami | 123/467 |
| 4,475,515 | 10/1984 | Mowbray | 123/407 |
| 4,586,656 | 5/1986 | Wich | 239/88 |
| 4,640,252 | 2/1987 | Nakamura | 123/467 |
| 4,669,429 | 6/1987 | Nishida | 123/447 |

OTHER PUBLICATIONS

W. F. Ball, "Two Novel Diesel Injection Systems," SAE Technical Paper Series, 840272, Mar. 1984.

*Primary Examiner*—Carl S. Miller

*Attorney, Agent, or Firm*—Synnestvedt & Lechner

[57] ABSTRACT

A high pressure fuel injection system utilizes a pressure regulating or control valve to provide a high residual pressure within the injector between injections. Maintaining a high residual fuel pressure boosts the injection pressure to provide improved fuel atomization, with consequent reductions in particulate emissions and increased fuel efficiency. The pressure regulating valve, which may be located in the injector leak-off fuel conduits or in the high pressure line connecting the fuel injection pump with the injector, may be controlled in accordance with engine operating conditions to provide a variable injection pressure boost commensurate with engine requirements.

17 Claims, 8 Drawing Sheets

MANIFOLD PRESSURE INLET
HIGH
LOW
FUEL TANK

Fig. 9. CONVENTIONAL SYSTEM
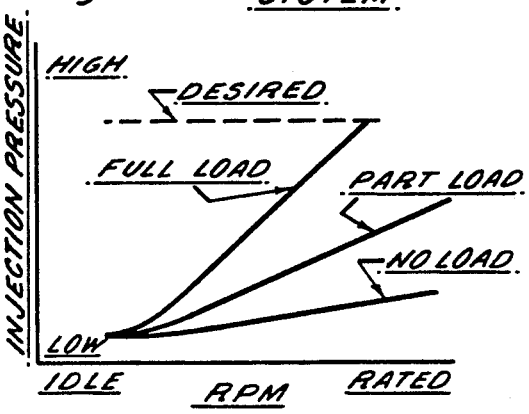
Fig. 10.
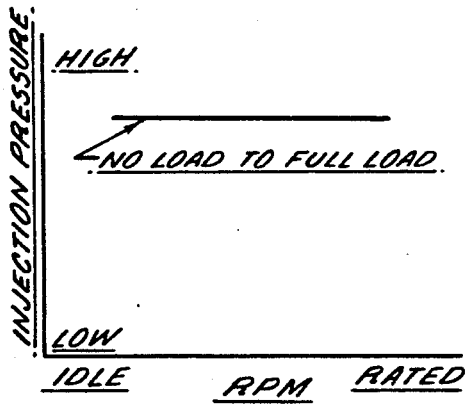
Fig. 11.
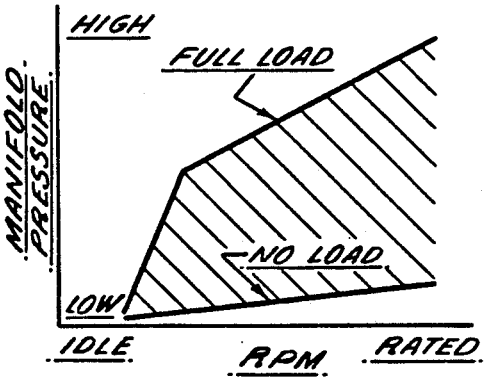
Fig. 12.
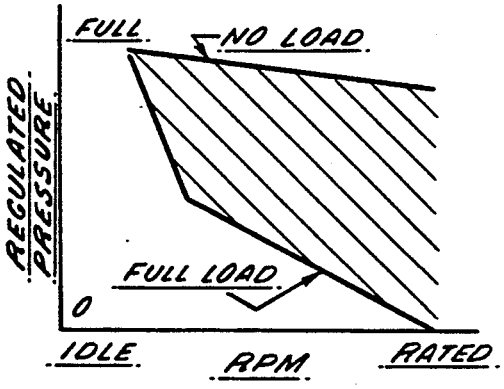

HIGH PRESSURE LINE FROM PUMP
HIGH PRESSURE LINE TO INJECTOR
MANIFOLD PRESSURE INLET
FUEL TANK

HIGH PRESSURE FUEL INJECTION SYSTEM

CROSS REFERENCE TO RELATED APPLICATION

This is a continuation-in-part of application Ser. No. 478,199, filed Feb. 7, 1990, which is a continuation-in-part of application Ser. No. 271,111, filed Nov. 14, 1988, now abandoned, which is a continuation-in-part of application Ser. No. 891,933, filed Jul. 30, 1986, now abandoned.

BACKGROUND OF THE INVENTION

The present invention relates generally to fuel injection systems for internal combustion engines, and more particularly to a high pressure fuel injection system for diesel engines.

Fuel injection is used in both diesel and gasoline fueled internal combustion engines in view of the precise control of fuel delivery obtainable, optimizing fuel timing and metering with a consequent improvement in engine efficiency. A typical fuel injection system includes a fuel supply tank, a fuel supply pump (low pressure), an injection pump (high pressure), at least one fuel injector and a control system. Pressurized fuel is supplied by the injection pump to a chamber located within the injector, adjacent to a discharge spray nozzle having one or more spray orifices. Such a fuel injector typically includes a spring biased valve at the entrance to the spray orifices and a fuel leak-off conduit which returns leakage fuel to the fuel tank to prevent pressure build up within the spring chamber which would detrimentally affect injector performance.

In diesel engines, a problem exists with particulate emissions which are generated over a wide range of engine speeds. Such particulates are usually composed of either carbonaceous solids, condensed and/or adsorbed hydrocarbons, or sulfates, with the solids component of such emissions correlated to smoke opacity. These particulates are formed in the fuel rich regions within a combustion chamber and are believed to result principally from low pressure fuel injection which produces poor fuel atomization. While over 95% of the particulates formed are subsequently burned as mixing and combustion continues in the combustion chamber, the remaining 5% is discharged in the engine exhaust to the atmosphere.

While increased injection pressures can reduce both particulate emissions and fuel consumption, it is difficult to achieve the proper injection pressures over a wide range of engine speeds and loads. Generally, an injection pump provides a lower rate of fuel delivery at low speeds and a higher rate of fuel delivery at high speeds. Since the typical injector nozzle is a fixed orifice, the varying injection rate results in a variation in injection pressure. At low speed, the injection pressure is low and at high speed it is high. However, both a naturally aspirated and a turbo charged engine need equal or higher injection pressure at speeds and loads lower than rated for good mixing and combustion. The injection system, pump and nozzle orifice size are designed around the maximum pressure and flow quantity required at the maximum rated engine conditions. Since this occurs at the maximum load and speed condition, such injection systems generally operate to provide less than optimal output at other engine speeds and loads, thereby reducing combustion efficiency and increasing the amount of particulate emissions.

One solution to this problem involves modifying the pump to provide higher pressures at low speed conditions. However, this can result in very high pressures at high speed conditions which would overstress the injection system and deteriorate engine performance. A pressure relief device may be provided in the high pressure fuel supply tube to relieve the excess pressure. However, the pump design then becomes more complicated, especially with a multiple injection system. To insure proper fuel distribution to each engine cylinder would require a separate pressure relief device due to the sequential injection requirements of the engine. Such a complex system would significantly increase the cost of an injection system with a probable decrease in reliability. Utilizing a pressure relief device also reduces pumping efficiency by bleeding off varying quantities of pressurized fuel.

Consequently, what is needed in the art is a fuel injection system which provides higher injection pressures over a wide range of engine speeds and loads without overly complicating the injection system or unduly sacrificing pump efficiency.

SUMMARY OF THE INVENTION

The present invention boosts the injection pressure over a predetermined range of engine speed and load conditions by selectively increasing the residual pressure in the injector and associated conduits. The residual pressure is increased by means of pressure influencing means such as a pressure regulating valve for regulating in the injector leakage return conduit or in the high pressure fuel conduits connecting the fuel injection pump with the injetors. In a preferred embodiment, the pressure influencing means is controlled in accordance with engine operating conditions, particularly inlet manifold pressure, load and/or speed to provide a residual pressure and hence an injection pressure boost commensurate with the particular requirements of the engine.

It is accordingly a primary object of the present invention to provide a fuel injection system which increases fuel injection pressure over a range of engine inlet manifold pressure, and speed conditions to reduce particulate emissions and increase fuel efficiency.

A further object of the invention is to provide a fuel injection system as described which optimizes pumping efficiency.

Another object of the invention is to provide a fuel injection system as described which employs substantially conventional fuel injection pumps and injectors and is accordingly economical to manufacture and install.

Additional objects and advantages of the invention will be more readily apparent from the following description of preferred embodiments thereof.

BRIEF DESCRIPTION OF THE DRAWINGS

FIG. 9 is a graphical illustration showing injection pressure as a function of speed for no load, part load and full load conditions for a conventional pump and showing in a broken line the desired injection pressure for all loads as a function of speed;

FIG. 10 is a graphical illustration showing achievable injection pressure for all loads as a function of speed for a pump equipped with the present invention;

FIG. 11 is a graphical illustration showing manifold pressure as a function of speed from no load to full load conditions for a typical diesel engine;

FIG. 12 is a graphical illustration showing regulated supply pressure or a function of speed from no load to full load as utilized in the present invention to control the injector pressure influencing device;

DESCRIPTION OF THE PREFERRED EMBODIMENTS

Figure 1:
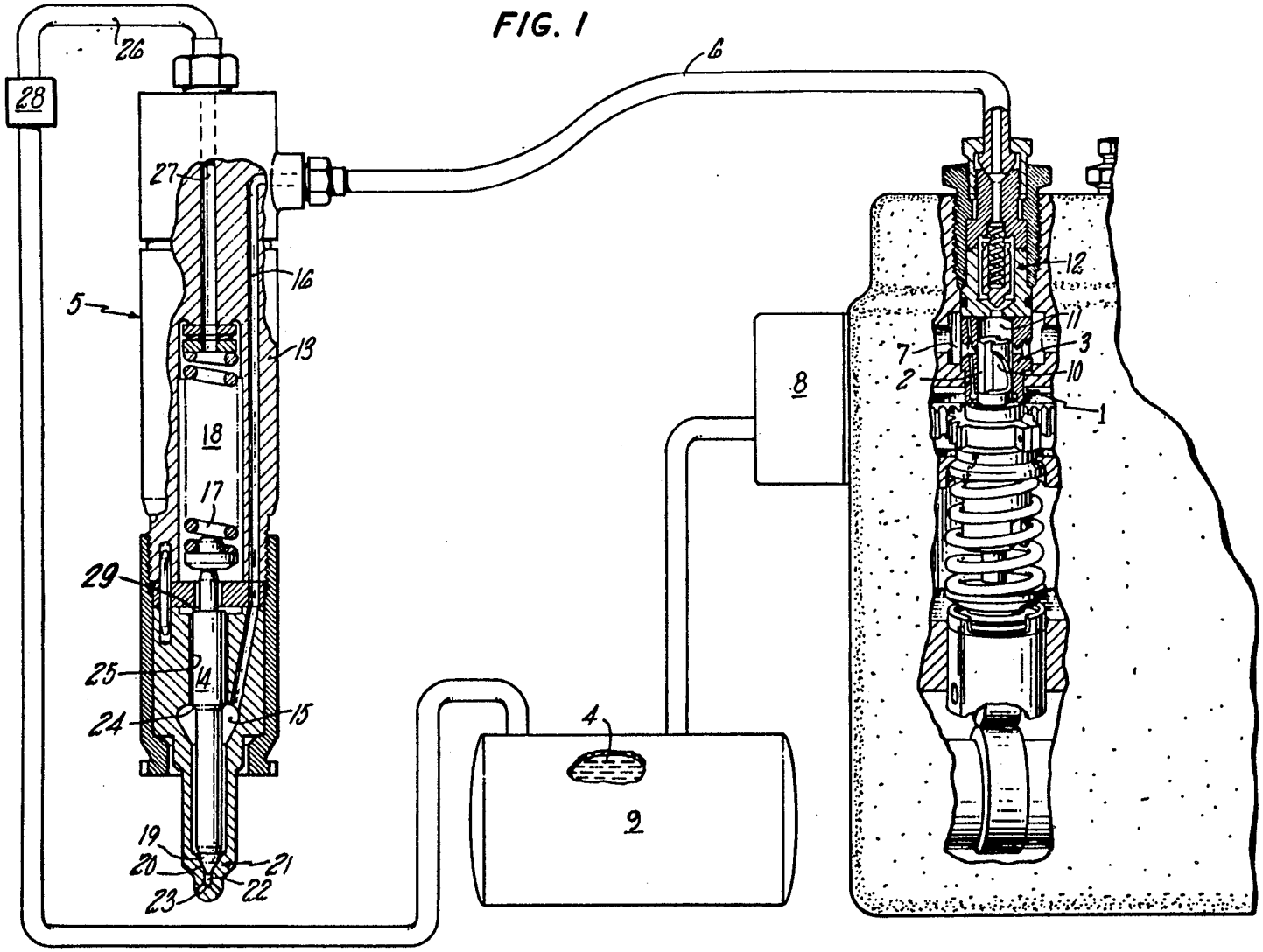
FIG. 1 is a schematic illustration of a first embodiment of a high pressure fuel injection system in accordance with the prevent invention.

Referring to FIG. 1, a fuel injection system is schematically shown illustrating the basic components of an embodiment of the present invention. While most applications will involve multiple injectors, a single injector system is shown to illustrate the features and advantages of the present invention while avoiding undue complexity. The engine for which this system provides fuel delivery is not shown, but comprises a piston type diesel engine having a combustion chamber into which the system injects a spray of fuel at timed intervals.

Referring to FIG. 1, an injection pump 1 includes a metering plunger 2 which is reciprocally and rotatably movable within a barrel 3. For illustrative purposes, the pump 1 is a diesel fuel injection pump such as a model 300 pump produced by AMBAC International, Columbia, S.C. The pump 1, which is driven by the engine, supplies fuel 4 to an injector 5 through a fuel injection tube 6. The fuel is delivered at a regulated low pressure to a fuel sump 7 of the pump 1 by a supply pump 8 which is connected to a fuel supply tank 9. When the plunger 2 is at the bottom of its stroke, fuel enters the barrel chamber 11 above the plunger through an inlet port from sump 7. The rising plunger closes the inlet, initiating fuel delivery under high pressure to the injection tube 6. Fuel delivery ends when the helical slot 10 of the plunger communicates with a spill port. Rotation of the plunger by the control rack controls duration of injection and hence fuel metering by varying the effective pumping stroke of the plunger. Rapid reciprocal movement of the plunger accordingly delivers high pressure metered pulses of fuel to the injector 5 through the injector tube 6. A check valve 12 is disposed in the entrance to the injection tube 6 to prevent back flow from the injector 5 to the pump 1, and thereby prevents the residual injector pressure from bleeding off through the pump. The check valve 12 must have no retraction volume and no seat leakage.

The injector 5 includes a body 13, and an injector valve 14 which is reciprocally movable within a fuel pressure chamber 15 within the injector 5, with a fuel duct 16 providing fluid communication between the chamber 15 and the injection tube 6. The injector 5 may, for example, be a diesel fuel injector such as a model NHM 780352, sold by AMBAC International, Columbia, S.C. A spring 17 is disposed within a spring chamber 18 and resiliently biases the valve 14 downwardly. The valve 14 includes a valve end 19 which mates with a valve seat 20, together comprising a valve assembly 21. Below the valve assembly 21 is a spray chamber 22 which includes one or more spray orifices 23. The valve 14 also includes a beveled face 24 located on a portion of the plunger disposed in the pressure chamber 15. A clearance 25 between valve 14 and the injector body permits reciprocating movement of the plunger and, due to the high pressure in the pressure chamber 15, also provides a leakage path for fuel into the spring chamber 18. A supplemental leakage path between high pressure duct 16 and spring chamber 18 can also be provided in the form of a small orifice. This can improve leakage control and residual pressure generation rate. A fuel return or leak-off tube 26 provides means for returning the leakage portion of the delivered fuel to the fuel supply tank 9.

A pressure influencing device 28, preferably a regulating valve, is disposed within the return tube 26 and variably restricts the return fuel flow, thereby variably controlling the residual pressure within the spring chamber 18, pressure chamber 15, duct 16 and injection tube 6. While a regulating valve is preferred, other pressure influencing devices may also be used.

In operation, the injection pump 1 is engine driven and provides periodic pressurized pulses of metered fuel to the injector pressure chamber 15 through the injection tube 6 and injector duct 16. Each pressure pulse causes a pressure build up in the chamber 15, which acts against the valve face 24 of the plunger 14 in opposition to the valve closing force of spring 17. When the pressure in chamber 15 is sufficient to overcome the spring bias, the plunger 14 is lifted, opening the valve assembly 21 and allowing pressurized fuel to pass through the spray chamber 22 to the orifices 23. During the injection interval, when the pressure in chamber 15 is high, fuel leaks through the clearance 25 and/or alternate orifice path into the spring chamber 18. To prevent uncontrolled pressurization of the spring chamber 18, which eventually would alter the injector opening and closing characteristics, this leaked fuel is passed through the spring chamber 18, through the conduit 27 and the return tube 26, to the fuel supply tank.

Figure 2A:
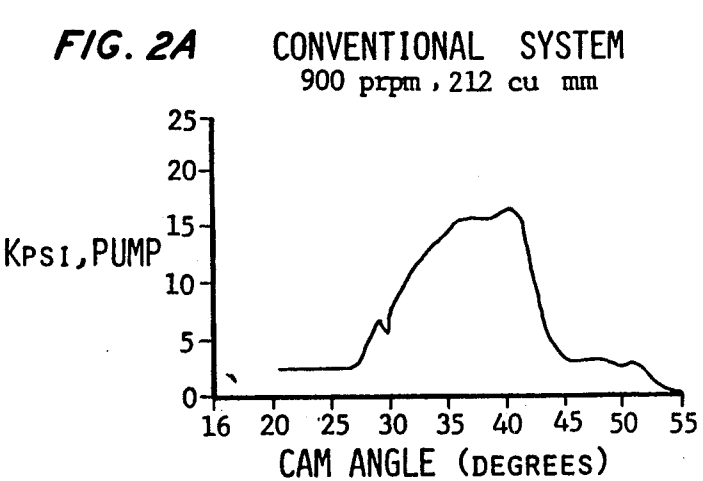
FIGS. 2*a* and 2*b* are graphical illustrations of two typical pumping cycles for a fuel injection system at high and low fuel requirements, respectively.
Figure 2B:
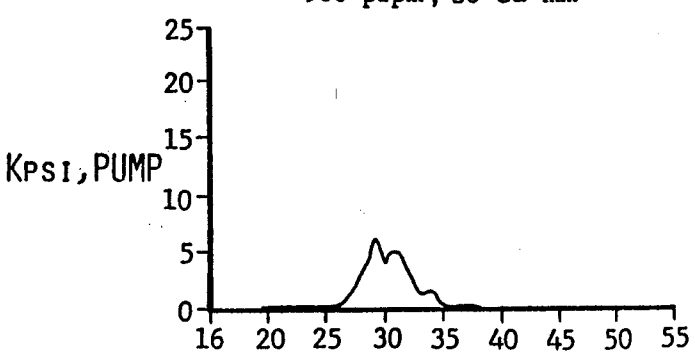

In a conventional fuel injection system, the initial delay in valve closing, leakage through clearance 25 and the retraction volume of the check valve 12 combine to reduce the residual pressure between injections to a very low pressure. Referring to FIGS. 2*a* and 2*b*, conventional pressure curves for a single injection cycle are shown for two different fuel requirements. From FIG. 2*b*, it is seen that at a requirement of 30 cu mm, the injection pressure begins at substantially zero, rises to about 5 kpsi, and then drops back to substantially zero. Such low pressure fuel injection, caused in large measure by the low residual pressure, results in reduced combustion efficiency and increased particulate emissions.

By the addition of pressure influencing device 28, preferably a regulating valve, in the fuel return tube 26, and the use of a zero retraction volume check valve 12, the pressure of the fuel in the injection tube 6, duct 16, injector chamber 15 and the spring chamber 18 can be increased to provide a residual pressure which is greater than the conventional nozzle opening pressure. Consequently, the entire injection cycle pressure curve is shifted higher, providing higher pressure injection independent of speed over all engine ranges. Such high pressure injection increases atomization, improving mixing within the combustion chamber and thereby reducing particulate formation and emissions.

The increase in residual pressure acting in the spring chamber 18 against the upper end of the plunger face 29 more than offsets the effect of the pressure boost on the valve face 24 in the injector pressure chamber such that the valve assembly opening and closing rates respond mainly to spring pressure variations, with only a small deviation effected by the increased residual fuel pressure. This allows utilization of conventionally designed fuel injectors without altering spring settings, and with little increase in impact seat loading at nozzle closing even though the nozzle closing pressure has been substantially increased.

Figure 3A:
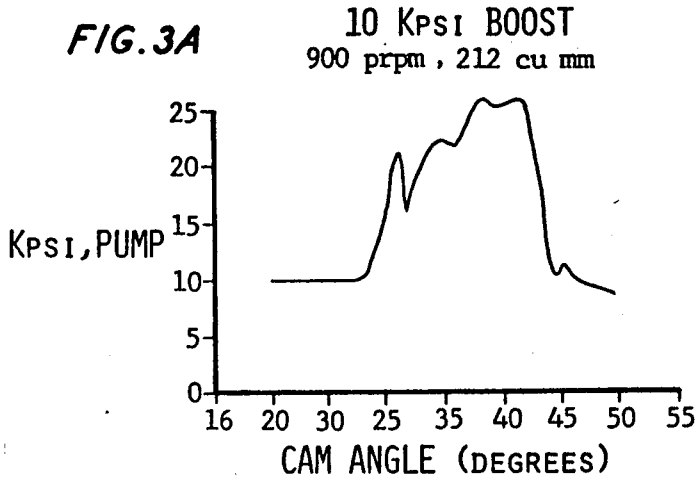
FIGS. 3*a* and 3*b* are graphical illustrations of the beneficial effects of the increased residual pressure provided by the high pressure fuel injection system of the present invention on two pumping cycles at high and low fuel requirements, respectively.
Figure 3B:
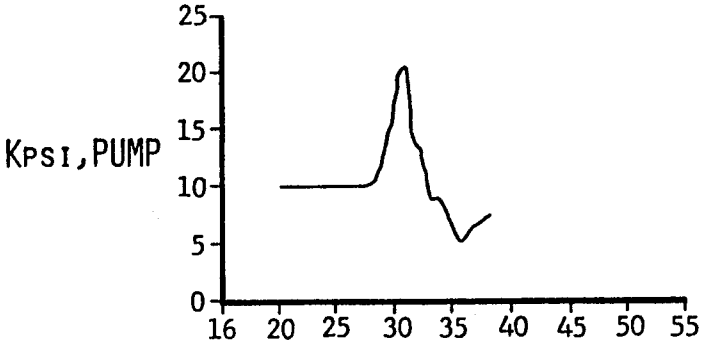

Referring to FIGS. 3*a* and 3*b*, the stepped up pressure curves are shown for an injection system incorporating the present invention which provides a residual pressure between injections of substantially 10 kpsi. From the graph of FIG. 3*a*, it is seen that at a fuel requirement of 30 cu mm, the fuel is injected at pressure in excess of 25 kpsi. The residual pressure between injections is a function of the regulated pressure in the spring chamber 18.

While a simple self-contained pressure regulating valve, which senses residual pressure and responds by variably restricting the fuel return flow, could be used to deliver a constant boost in injection pressure over the full range of engine speeds, a remotely controlled valve may also be used, actuated by an engine control system which monitors and controls engine operation, thereby optimizing the reduction in particulates and maximizing fuel economy. Of course, the choice of pressure influencing device and degree of control desired will vary with each particular application.

A particular advantage of the present invention is that, where compatible with engine design, a single pressure influencing device could be used to boost the residual pressure in a multiple injection system. The return tubes could be connected to a common return tube which includes the valve or pump, to boost the residual pressure boosted of all the injectors. Or, as disclosed in a below-described embodiment, a single valve can be used in a manifold joining the high pressure fuel lines between the injection pump and injectors. This significantly simplifies the modifications required in the injection system as well as the control system requirements.

While the injection system of the present invention is described in relation to a separate pump and injector system, it will be understood by those skilled in the art that this invention is equally applicable to unitary injectors which employ integral pumps.

Figure 4:
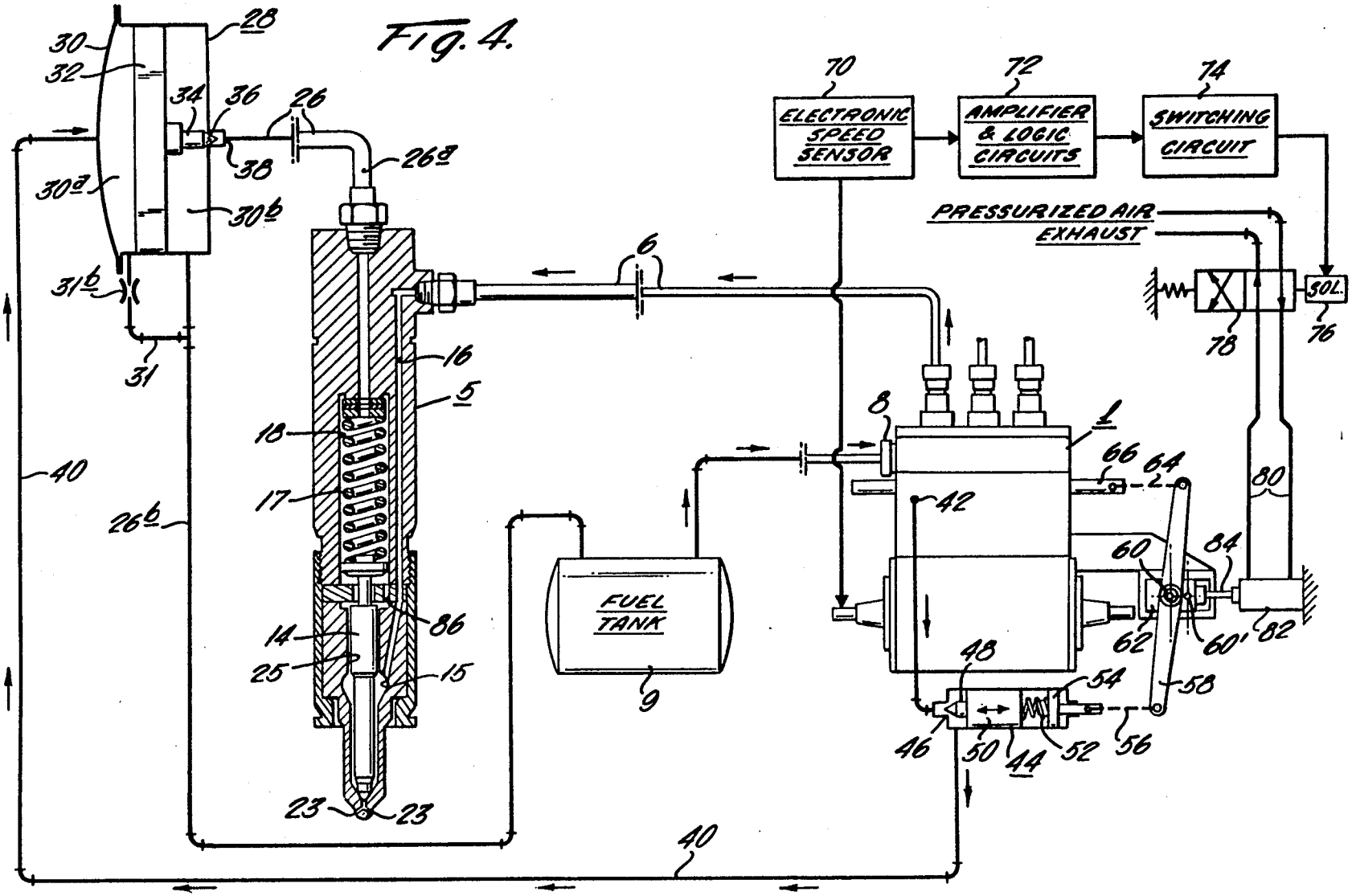
FIG. 4 is a schematic illustration of a second embodiment of a high pressure fuel injection system in accordance with the invention.

In FIG. 4, a modified system in accordance with the invention is schematically illustrated for controlling residual pressure within the injector and related conduits between injections. In this embodiment, means are provided for variably controlling the residual pressure in response to engine operating conditions, particularly load and speed.

The embodiment of FIG. 4 is similar to the system shown in FIG. 1 and includes a pump 1 and injector 5 of the same type shown in FIG. 1. As with the prior embodiment, the pump 1 is provided with a check valve having no retraction volume. Fuel from a fuel supply tank 9 is pumped by the supply pump 8 into the injection pump 1 and the injection pump plunger (not shown) which is as shown in FIG. 1, pumps timed and metered pulses of fuel at high pressure through the injection tube 6 into the injector duct 16 from which it flows into the chamber 15 to lift the injector plunger 14 against the force of the spring 17 in spring chamber 18. Upon opening of the plunger, pressurized fuel passes through the spray orifices 23 into the engine cylinder. Leakage along the plunger clearance 25 into the spring chamber 18 is returned to the fuel tank 9 through the return tube 26, the flow through tube 26 passing through pressure influencing device 28 which in the embodiment of FIG. 4 comprises a piston type pressure regulating device. This device includes a closed cylindrical chamber 30 within which is slideably disposed a piston 32. A valve element 34 extends from one side of the piston 32 and is cooperatively disposed with respect to a valve seat 36 leading to a port 38 communicating with the return tube portion 26*a*. The piston 32 divides the cylinder 30 into closed chambers 30*a* and 30*b*, the chamber 30*b* receiving fuel through the port 38 past the variable orifice between valve element 34 and valve seat 36. The chamber 30*b* is maintained at a low substantially atmospheric pressure by connection to the fuel tank by means of return tube portion 26*b*. Chamber 30*a* is connected by bleed tube 31 having a restricted orifice 31*b* to the return tube 26*b*. The diameter of the piston 32 is substantially larger than the diameter of the valve seat 36, and in a preferred embodiment the ratio of the resultant areas is approximately 200:1. The residual pressure in the spring chamber 18 would be in this same ratio to the pressure in the chamber 30*a*.

In the embodiment of FIG. 4, the chamber 30*a* of the device 28 is connected by conduit 40 to a port 42 of the injection pump communicating with the regulated output pressure of the supply pump 8 which typically provides a substantially constant fuel pressure at port 42 of approximately 50 psi. A pressure regulating valve 44 is interposed in the conduit 40 between the port 42 and the device 28 to control the pressure in the chamber 30*a* in accordance with at least engine load and possibly engine speed depending on the needs of the particular system. The regulating valve 44 includes a valve seat 46 and valve element 48 cooperating therewith and carried by piston 50 which is biased by spring 52 toward the valve seat. The spring 54 at its end opposite the piston 50 bears against a slideable spring seat 54 connected by link 56 to one end of lever 58. The lever 58 is centrally pivoted at 60 to a slideably mounted member 62 which is moveable in a direction substantially parallel to the movement of the piston 50 of valve 44. At its opposite end from the connection to link 56, the lever 58 is pivotally connected to a link 64 which in turn is pivotally connected to the fuel control rack 66 of the pump 1. As viewed in FIG. 4, movement of the rack 66 to the right results in increased fuel delivery of the pump, while a movement to the left would produce a decreased fuel delivery.

With the arrangement described, it can be appreciated that movement of the fuel control rack 66 to the right to produce a greater torque output of the engine will result in a clockwise rotation of the lever 58 and consequently a leftward movement of the spring seat 54, thus effectively increasing the spring force of spring 52 and lowering the regulated pressure of chamber 30*a* of the device 28. This will cause a leftward movement of the piston 32 and an increased opening of the valve member 34 and a consequent reduction in the pressure in return tube portion 26*a*, spring chamber 18 and the pressure chamber 15 as well as duct 16 and injection tube 6.

Conversely, a movement of the fuel rack 66 toward a decreased fuel position will result in a counterclockwise movement of lever 58, a rightward movement of spring seat 54 and a higher output pressure from the valve 44, thus producing a higher pressure in chamber 30*a*, a rightward movement of piston 32 and valve 34 and a consequent increase in residual pressure in return tube 26, spring chamber 18, pressure chamber 15 and associated conduits. The regulated pressure output range of the valve 44 might typically vary from 0 to 50 psi which, if a 200:1 ratio of the device 28 were provided, would result in a residual pressure range of approximately 0–10,000 psi in the spring chamber 18. The ranges are of course by way of example and could be readily varied as necessary to suit the requirements of the particular system installation.

In certain situations, for example those engines having little torque back-up, the injection pump will generate less than desired injection pressure with the rack at full load. For such engines, a speed function is desirably added to influence the regulator valve 44. As illustrated in the system shown schematically in FIG. 4, an electronic speed sensor 70 is provided associated with the injector pump drive shaft which is coupled to the engine crankshaft. The speed sensor through amplifier and logic circuits 72 and switching circuits 74 controls solenoid 76 of a solenoid valve 78. The valve 78 selectively controls the movement of pressurized air through conduits 80 to an air cylinder 82, the piston rod 84 of which is connected to the slideable member 62 on which the lever 58 is pivotally mounted at 60. In order to provide an increased injection pressure boost in a predetermined speed range, the sensor 70 upon sensing speed entry into the range will through the circuits 72 and 74 energize solenoid 76 to actuate cylinder 82 and move the pivot point 60 of the lever 58 rightwardly to a new position, for example 60', as illustrated in FIG. 4. This will effectively increase the pressure output of pressure regulating valve 44 and thus the residual pressure in the injector without affecting the influence of the load sensing mechanism (lever 58, links 56, 64) on the valve.

In order to enhance the transfer of leakage fuel from the clearance 25 to the spring chamber, a hole 86 is provided in the injection spacer 87. In addition, the clearance 25 may be increased slightly from the conventional practice of 80–120 millionths to a approximately 110–150 millionths. The resultant slight increase in the leakage into the spring chamber will result in a faster response of the system to the pressure regulator.

A further embodiment of the invention is shown in FIGS. 5–8. In this embodiment, the pressure influencing device 28' is incorporated into the upper end of the injector body. The pressure regulating valve 44' comprises a spool type valve controlled principally by engine intake manifold pressure to modulate the fuel supply pressure which in turn controls the pressure influencing device 28'. As shown in FIG. 11, in most turbo charged engines, manifold pressure is a function of load.

Figures 5, 6, 7:
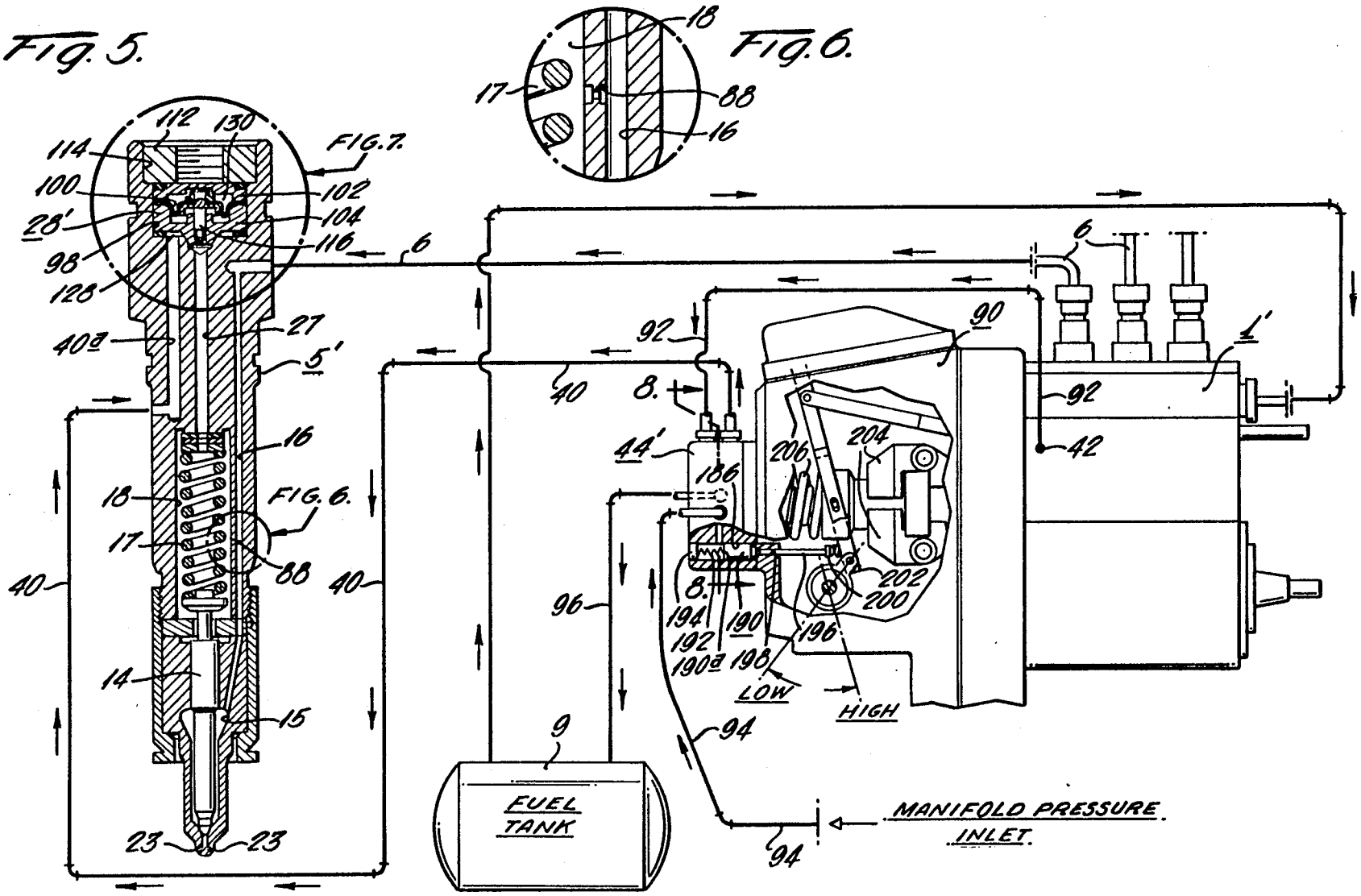
FIG. 5 is a schematic illustration of a third embodiment of a high pressure fuel injection system in accordance with the invention.
FIG. 6 is an enlarged sectional view of the circled portion of FIG. 5.
FIG. 7 is an enlarged sectional view of the upper end of the injector of the system shown in FIG. 5.
Figure 7:
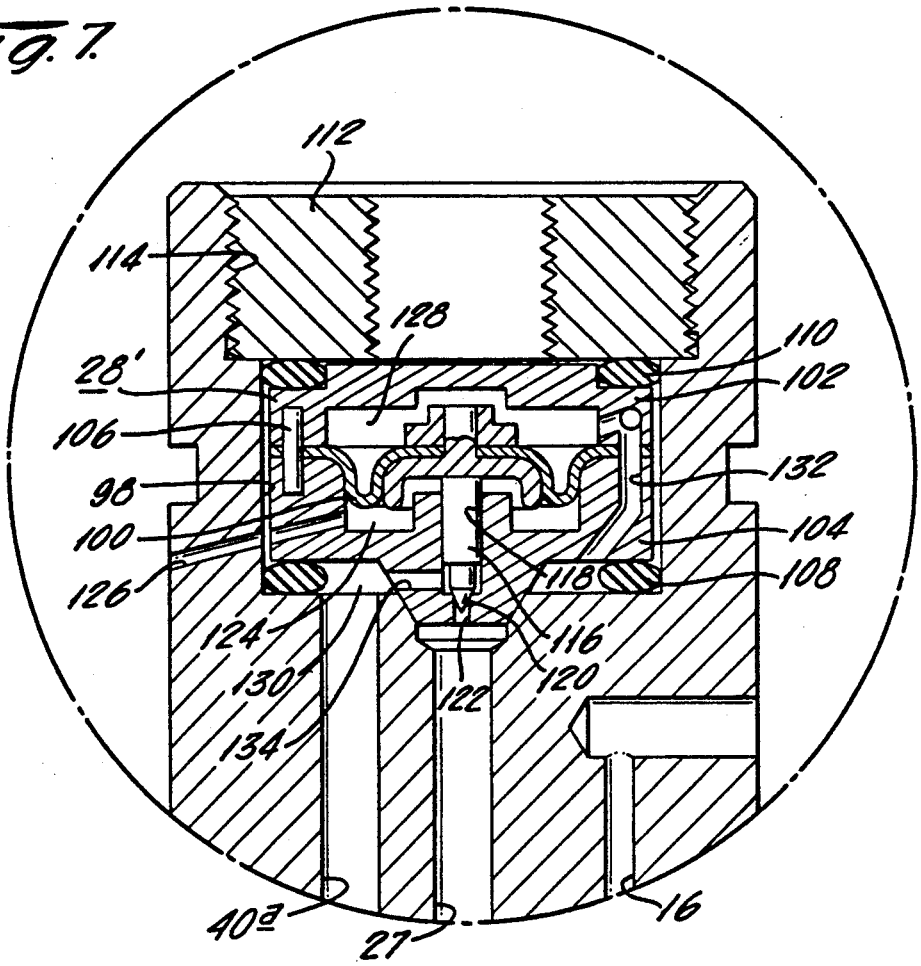

With reference to the schematic view of FIG. 5, the fuel injection pump 1' is provided with a mechanical governor 90 of an essentially conventional construction. The pump 1' is equipped with check valves having no retraction volume. The high pressure fuel outlets of the pump 1' are connected with a plurality of injectors 5' by means of injection tubes 6. For simplicity, only one injector 5' and one injection tube 6 is shown in FIG. 5. The injection pump 1' is supplied with fuel from a fuel tank 9, the fuel being delivered to the pump plungers by an internal fuel supply pump (not shown) in a conventional manner. The fuel supply pump maintains a substantially constant output pressure of approximately 50 psi, which supply pump output pressure is made available for use by the regulating valve 44' at a port 42 of the injection pump as in the previously described embodiment. This supply pressure is directed by a conduit 92 to the regulating valve 44' which is mounted on the end of the governor 90. The regulated pressure from the regulating valve 44 is transmitted by way of conduit 40 to the injector 5' and by way of internal injector conduit 40*a* to the pressure influencing device 28.

As indicated, the regulating valve 44' is controlled principally by the engine intake manifold pressure, and for this purpose a conduit 94 is provided for delivering the intake manifold pressure to the valve 44'. A drain line 96 connects the valve 44' with the tank for a purpose which will become evident from the following description of the regulating valve details.

The injector 5' is basically conventional other than the addition of the device 28' and accordingly bears the same reference numerals as the previous embodiments. One departure from the previous embodiments is the substitution of a bleed orifice 88 connecting the spring chamber 18 with the injector duct 16. This arrangement eliminates the need for the increased clearance between the valve needle and injector body described in the embodiment of FIG. 4.

The details of the pressure influencing device 28' disposed within the upper end of the injector 5' are shown in FIG. 7 wherein it may be seen that the device 28' is disposed within a bore 98 in the upper end of the valve body. The device 28' essentially comprises a diaphragm valve including a rolling diaphragm 100 which is clamped between upper valve member 102 and lower valve member 104. The valve members are aligned by aligning pins 106 and are sealed within the bore 98 by lower seal ring 108 and upper seal ring 110. A threaded plug 112 in bore 114 bears against the seal ring 110 to sealingly clamp the valve assembly in position.

A valve needle 116 is secured at its upper end to the diaphragm 100 and is slidingly disposed within a bore 118 in the lower valve member 104. At its lower end, the valve needle 116 cooperates with a valve seat 120 to regulate flow through a passage 122 which connects with the spring chamber leak-off conduit 27.

The chamber 124 beneath the diaphragm 100 is vented to atmospheric pressure by means of passage 126 in the valve body. The chamber 128 is supplied with the regulated supply pump pressure directed to the injector through conduit 40. The conduit 40 connects with the internal conduit 40a which opens into the annulus 130 between the lower valve member 104 and the end of the bore 98. The annulus 130 is connected with the chamber 128 above the diaphragm 100 by means of passage 132. Leak-off fuel which passes from the leak-off conduit 27 through passage 122 flows through passage 134 into the annulus 130.

The device 28' functions in the same manner as the device 28 described in the embodiment of FIG. 4. The regulated fuel supply pressure which is modulated in accordance with engine operating conditions actuates the diaphragm valve against the reference atmospheric pressure to regulate the leak-off conduit pressure. The device 28' differs from the device 28 in that the fuel which passes through the valve instead of passing into the line to tank, passes into the regulated supply pressure conduit. This flow is small, and as will be described, there is a bleed to drain in the regulated fuel supply line which is necessary to permit rapid response of the device 28' to changing engine operating conditions.

Figure 8:
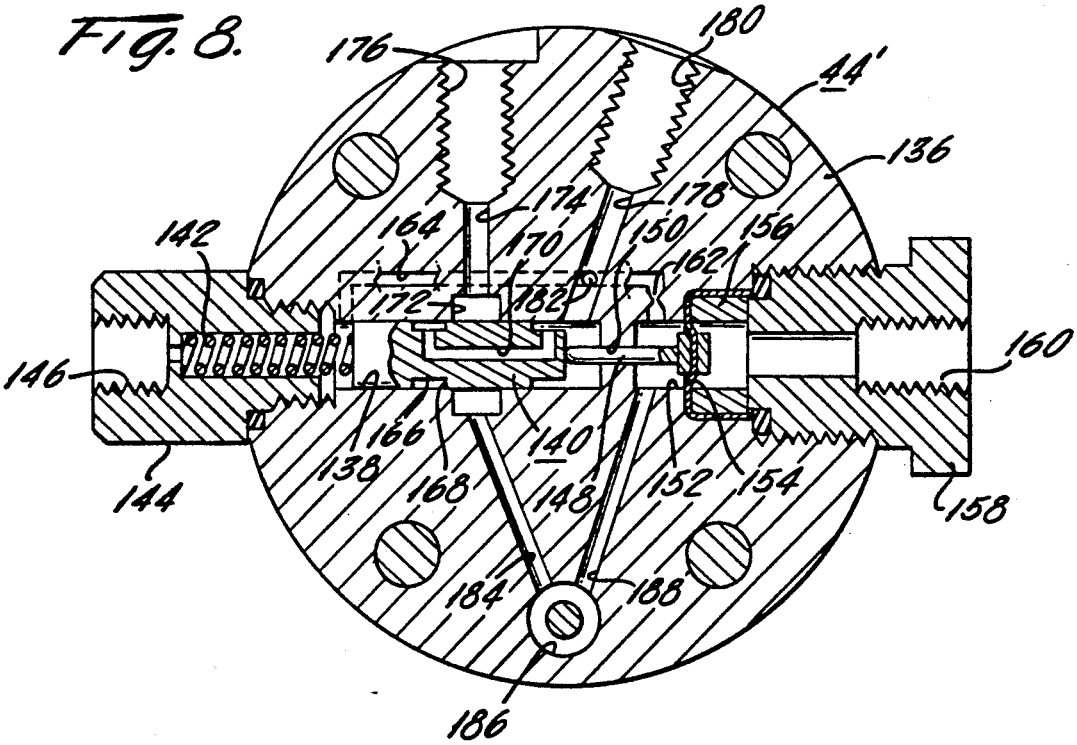
FIG. 8 is an enlarged sectional view taken along line 8—8 of FIG. 5 showing details of the fuel pressure regulating valve.

The regulating valve 44' is shown in detail in FIG. 8 and includes a valve body 136 having a valve bore 138 extending partway therethrough. A valve spool 140 is slideably disposed in the bore 138 and is biased to the right as viewed in FIG. 8 by a spring 142 disposed within the threadedly mounted outlet fitting 144. The left hand end of the bore 138 is connected to the drain line 96 to tank by means of threaded bore 146 in the fitting 144.

The position of the plunger 140 is controlled by a connecting rod 148 slideably disposed within passage 150 of the valve body 136. The control rod 148 extends into a bore 152 aligned with the bore 138 and bears against a diaphragm 154 which is secured to seal off the bore 152 by the diagragm retaining spacer 156 which in turn is held in place by the threaded outlet fitting 158. The threaded outlet port 160 of the fitting 158 is connected with the conduit 94 leading to the engine intake manifold. The diaphragm 154 is accordingly exposed to engine intake manifold pressure on the right side as viewed in FIG. 8. The left side of the diaphragm is connected to drain by means of a shunt orifice 162 leading from bore 152 to internal drain passage 164 in the valve body 136 which communicates with the left hand end of the bore 138 and hence the drain line 96 to tank. The position of the plunger 140 will accordingly be determined by the engine intake manifold pressure which is substantially proportional to engine load.

The plunger 140 includes an annulus 166 forming a shoulder 168 along the right side thereof. An internal passage 170 in the plunger connects the annulus 166 with the right hand end of the bore 138.

An annulus 172 in the valve body around the bore 138 connects with a conduit 174 and threaded outlet 176 to the fuel conduit 92 connected with the fuel supply pump at 42. A slight movement of the diaphragm 154 to the right in response to a decreasing manifold pressure will permit the plunger to move under the force of spring 142 to the right, allowing shoulder 168 to pass the edge of the annulus 172 and permitting the fuel supply pump pressure from conduits 92 and 174 to pass into the plunger annulus 166 and thence through passage 170 to the right hand end of the bore 138. A conduit 178 in communication with the right hand end of the bore 138 leads to threaded outlet 180 which is connected to the conduit 40 and thence to the injector to modulate the pressure controlling the device 28'. A shunt orifice 182 connects the passage 178 with the drain passage 164 and by providing a continual bleed to drain allows the plunger to move responsively to manifold pressure changes.

Although the regulating valve 44' is primarily engine load responsive, means are provided to override the manifold pressure control at low engine speed. This means comprises a passage 184 leading from the annulus 172 to a bore 186 extending transversely to the bore 138. A further passage 188 connects the bore 186 with the bore 152. A speed sensing valve element 190 is slideably disposed in the bore 186 as shown in FIG. 5 and is baised to the right by a spring 192 bearing against a plug 194 at the left end of the bore 186. The valve element 190 includes an extension 196 which passes through a bore 198 in the governor housing. The end 200 of the extension engages the lower end of the governor fulcrum lever 202, the position of which is substantially dependent on engine speed, being dictated primarily by the position of flyweights 204. Upon collapse of the flyweights at low speed, the governor spring 206 moves the bottom of the fulcrum lever to the right as viewed in FIG. 5 and the valve 190 follows this movement under the influence of spring 192, thereby allowing the left end 190a to open communication between the passages 184, 188 and the bore 186. This permits fuel at supply pump pressure to pass into the bore 152 behind the diaphragm 154, thus moving the diaphragm to the right against manifold pressure and allowing the plunger 140 to also move to the right thereby increasing the modulated fuel pressure in the conduit 40 and hence in the device 28'.

The speed sensing valve element 190 accordingly provides an override of the manifold pressure acting on diaphragm 154 at low speed conditions. This speed sensing valve is an optional feature of the regulating valve 44' and should only be needed for certain types of engines, such as those having little torque back-up.

The graphs of FIGS. 9–12 illustrate the manner in which the invention and particularly the embodiment of FIGS. 5–8 can be employed to produce the desired high injection pressure over the full speed rang of the engine. In FIG. 11, it can be seen that the manifold pressure for a conventional turbo charged engine varies as a function of load, and secondarily of speed. Accordingly, as shown in FIG. 12, the regulated pressure obtained from the regulating valve 44' varies inversely with load and speed and accordingly will provide a higher boost to the residual pressure in the injector through the device 28' at low speed and low load conditions.

As shown in FIG. 9, this is exactly what is needed in the conventional injection system since it is usually only at full load and rated speed that the desired high injection pressures are obtained. Although the invention could be utilized in the manner shown in FIGS. 2 and 3 to boost the injection pressure for all load conditions, this can result in higher than desirable injection pressures at full load and rated speed. Accordingly, it is preferable to tailor the boost provided by the invention to provide appropriately higher increases in injection pressure at lower loads and lower speeds.

In FIG. 10, the result achieved by utilizing the invention is illustrated wherein the desired substantially constant high injection pressure is obtainable over the full load and speed range of the engine. This results in excellent fuel atomization and a minimumization of particulate emissions for all engine operating conditions.

An advantage of the injector embodiment shown in FIG. 5 is the location of all of the high pressure chambers and passages within the injector body. Furthermore, the leak-off passage, which in moderne four-valve engines is built into the engine casting, can be utilized for the regulated fuel conduit 40, eliminating the need for any additional plumbing.

As was the case with the embodiment of FIG. 1, the embodiments of FIGS. 4 and of FIGS. 5–8, although shown with a single injector, may obviously be employed in a multi-injector system. The pump illustrated in FIGS. 4 and 5 in fact has three outlet ports for use with a three injector system.

Should the system of FIG. 4 be used in a multi-injector system, there may either be a separate pressure influencing device 28 for each injector return tube 26, or in each injector conduit 27, or the injector return tubes can all be regulated by a single pressure influencing device 28.

Figures 13, 14, 15:
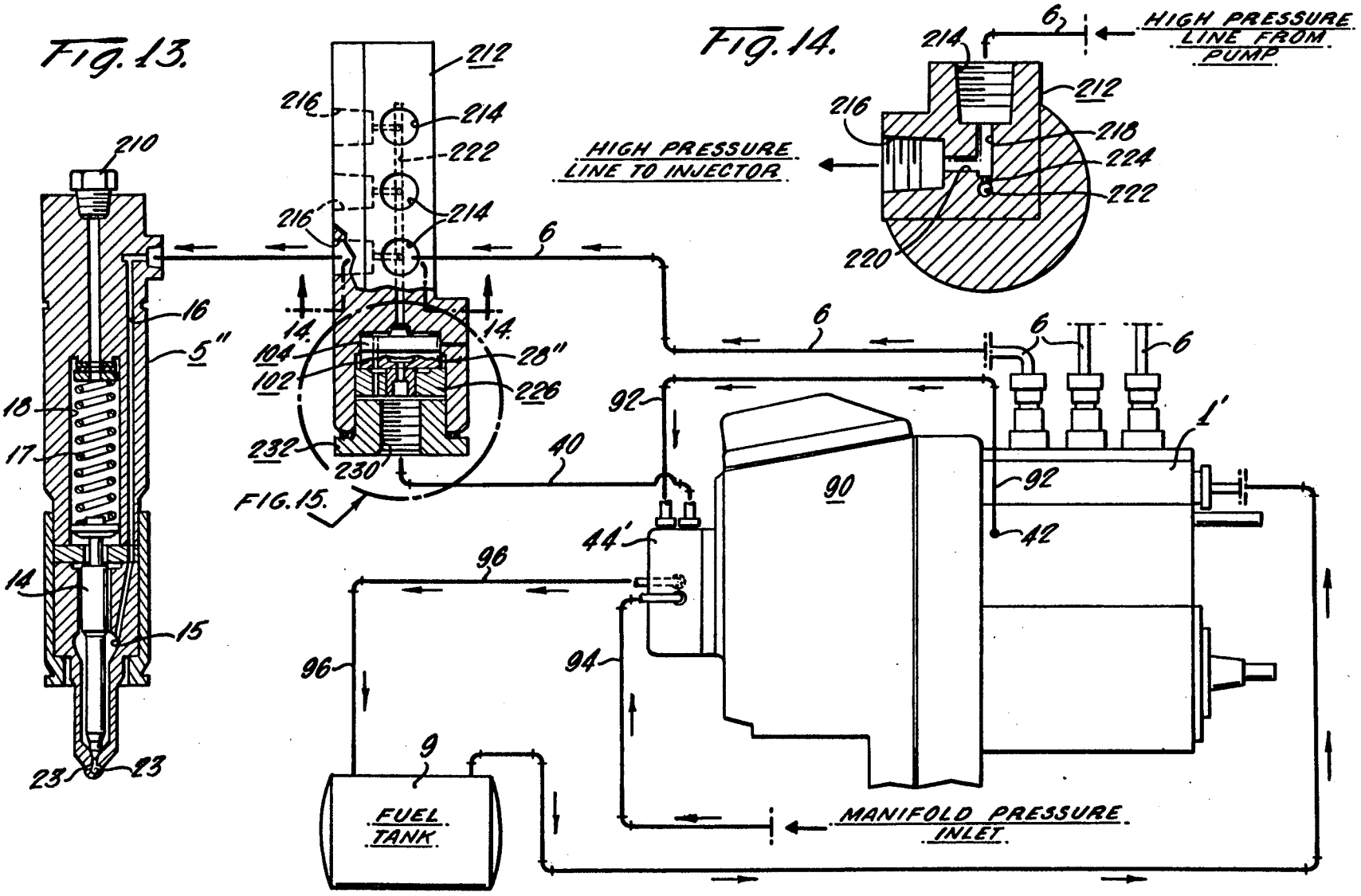
FIG. 13 is a schematic illustration of a fourth embodiment of a fuel injection system in accordance with the invention.
FIG. 14 is an enlarged sectional view taken along line 14—14 of FIG. 13.
FIG. 15 is an enlarged sectional view of the portion of FIG. 13 circled in broken lines.
Figure 15:
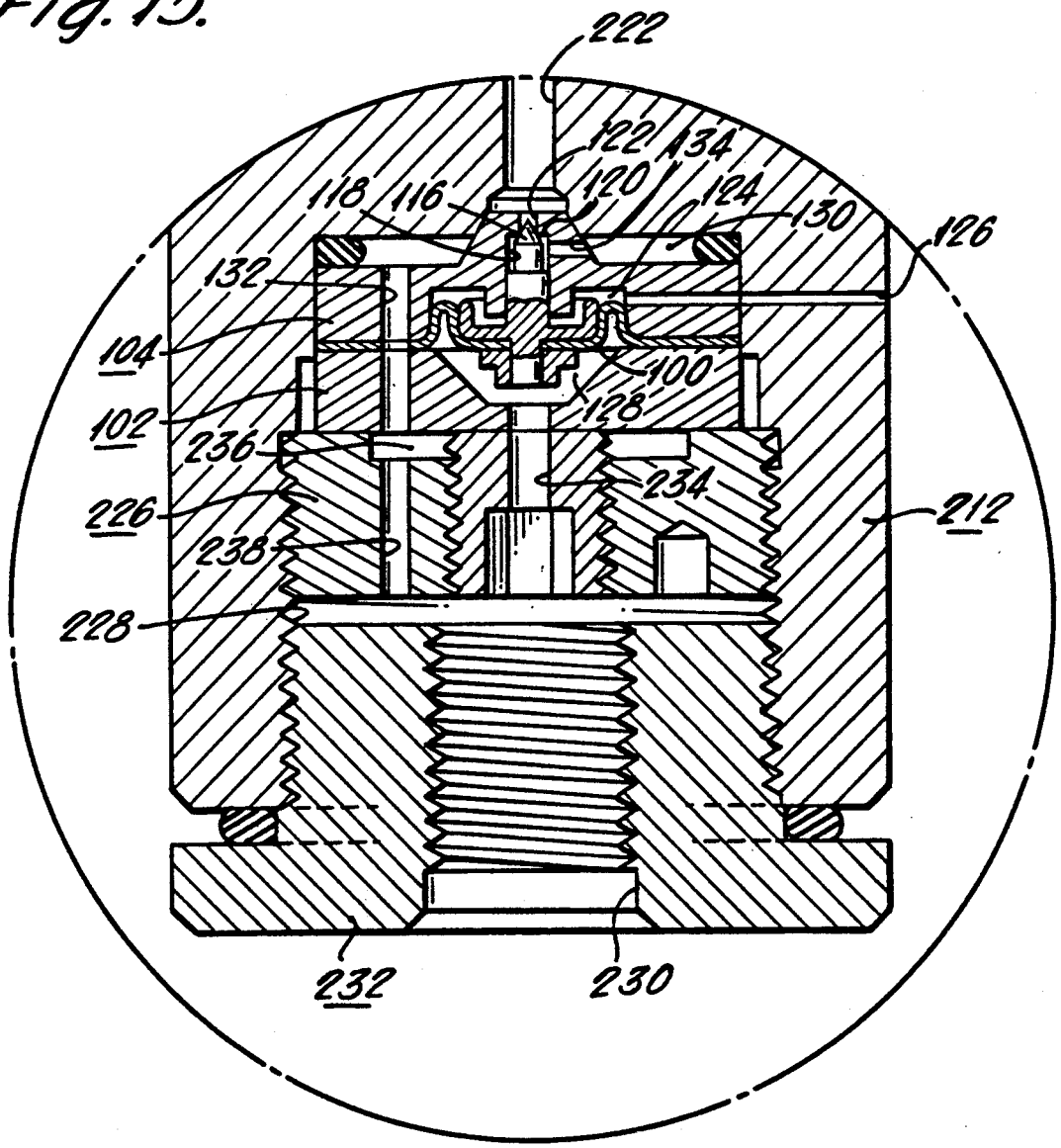

A still further embodiment of the invention is shown in FIGS. 13–15. This embodiment is quite similar to the embodiment of FIGS. 5–8, the principal difference being the location of the pressure influencing device 28" connected into the injection tube 6 between the injection pump and the injector rather than on the outer end of the injector assembly. The structure of the pressure influencing device and its function in the system is essentially the same as that of the preceding embodiment.

Referring to FIG. 13, the injection pump 90, regulating valve 44 and their respective connections with the fuel tank 9 are identical with that of the preceding embodiment, and the details thereof accordingly need not be discussed further. The injector 5" is essentially the same as that shown in the embodiments of FIGS. 1 and 4 and is of a conventional construction such as that identified with those previous embodiments. The leak-off conduit 27 of the injector 5" is blocked at its upper end by a plug 210, the employment of which converts the nozzle into a leakless nozzle. Pressure build-up in the spring chamber 18 is relieved to the extent necessary to prevent interference with the injector opening characteristics by allowing sufficient clearance 25 between the injector valve needle and the injector body. If desired, a bleed passage such as that shown at 88 in the FIG. 5 embodiment could be used to connect the spring chamber 18 with the injector duct 16.

Each of the injection tubes 6, through which the high pressure fuel injection pulses travel from the injection pump 90 to the injectors 5", passes through a block 212 to one end of which is mounted the pressure influencing device 28". As shown in the enlarged sectional view of FIG. 14, each tube 6 is connected with a block 212 at an inlet port 214 and exits from the block through an outlet port 216. Intersecting passages 218 and 220 respectively connect each pair of ports 214 and 216. Although only a single tube 6 is illustrated in FIG. 13 connected with the block 212, additional sets of inlet and outlet ports 214 and 216 are illustrated for a total number of three sets of ports for connection with the three outlets of the injection pump and for connection to the additional two injectors which are not shown.

A fuel conduit 222 extends longitudinally through the block 212 and communicates with each of the tubes 6 passing through the block by means of a bleed passage 224 as shown in FIG. 14. The conduit 222 communicates with the pressure influencing device 28" in the same manner as did the conduit 27 of the injector in the previous embodiments to provide a pressure regulation of the injector tubes 6 and the injector chambers including the spring chamber to maintain the desired residual fuel pressure in the injector and high pressure conduits between injections.

The details of the pressure influencing device are shown in FIG. 15. Since as indicated the structure and function of the pressure influencing device 28" is practically the same as that of the preceding embodiment and shown in detail in FIG. 7, the description thereof will be brief and common reference numerals will be employed.

The pressure influencing device 28" comprises a variable orifice diaphragm valve which includes a rolling diaphragm 100 clamped between valve members 102 and valve members 104. A threaded member 226 disposed in a threaded bore 228 of the block 212 clamps the valve members 102 and 104 in position. A valve needle 116 is secured to the diaphragm and is slidingly disposed within a bore 118 in the valve member 104. The valve needle 116 cooperates with valve seat 120 to regulate flow through a passage 122 connecting with the conduit 222.

The chamber 124 on the valve needle side of the diaphragm is vented to atmosphere through a passage 126 in the member 104 and block 212. The chamber 128 on the opposite side of the diaphragm is supplied with the regulated supply pump pressure from conduit 40 which, as shown in FIG. 13 is connected with a port 230 in a sealed member 232 threadedly engaged in the bore 228 of the block 212. Passage 234 provides communication between the chamber 128 and the port 230.

The small flow of fuel through the needle valve 116 passes through passage 134 into an annulus 130 from which it passes through a passage 132 in the members 102 and 104 into an annulus 236 in the member 226 and thence through a passage 238 into the bore 228 and thence through the port 230 into line 40. The flow past the needle valve, as was the case with the preceding embodiment, thus passes into the regulated fuel supply acting on the diaphragm chamber 128.

As indicated, the system shown in FIGS. 13–15 functions in an identical manner to that of FIGS. 5–8, the principal difference being the location of the pressure influencing device in the injection tube 6 rather than connected with the injector leak-off conduit. Since these latter passages are in communication, the function remains the same, namely to control the residual pressure in the injector and high pressure injection lines between injection intervals in accordance with engine speed and load as monitored by the controller 44'.

From the foregoing, it can be appreciated that the present system is readily adaptable for use with conventional injection system components, there being little or no modification required to the injection pump or the injectors, and no modification required to the engine.

Although mechanical arrangements are shown in the embodiments of FIGS. 4, FIGS. 5–8 and 13–15 to modify the pressure influencing device in accordance with engine load, it would be obvious that such function could be equally well accomplished by electronic controls.

Manifestly, changes in details of construction can be effected by those skilled in the art without departing from the invention.

We claim:

1. A fuel injection system for providing a controllable residual fuel pressure within a fuel injector between injections, characterized by:

a fuel injection pump connected to a fuel supply;

at least one fuel injector for periodically injecting fuel into an engine;

conduit means connecting said fuel injection pump with said fuel injector for delivery of fuel thereto;

a check valve disposed between said fuel injection pump and said conduit means to prevent fuel back flow to said fuel injection pump;

fuel return means for returning leakage fuel from said injector to said fuel supply;

pressure influencing means disposed within said fuel return means for controlling fuel pressure within said fuel return means in accordance with engine load, an increase in pressure within said fuel return means producing a corresponding increase in residual pressure within said injector and said conduit means, said pressure influencing means comprising a variable orifice valve.

2. The invention as claimed in claim 1, including means in said injector for enhancing the response of said pressure influencing means.

3. The invention as claimed in claim 2, wherein said injector comprises an injector plunger slidably disposed in close fitting relation within the injector body, and wherein said means for enhancing the response of said pressure influencing means comprises an increased clearance between said injector plunger and body to increase the flow of leakage fuel therebetween.

4. The invention as claimed in claim 1, wherein said means for enhancing the response of said pressure influencing means comprises a bleed orifice between said conduit means and said fuel return means.

5. The invention as claimed in claim 2, wherein said variable orifice valve comprises a piston-cylinder type valve wherein a piston divides a closed cylinder into first and second chambers, said first chamber communicating with said fuel supply, a port in said first chamber connected to said fuel return means, a valve seat associated with said port and a valve element carried by said piston for regulating leakage fuel flow through said port in accordance with the piston position in said cylinder, said second chamber being connected with a source of regulated presssurized fuel, and means for regulating said source of regulated pressurized fuel in accordance with engine load.

6. The invention as claimed in claim 5, wherein said latter means comprises a pressure regulating valve linked to the control rack of said injection pump.

7. The invention as claimed in claim 5, wherein said fuel injection pump comprises a fuel supply pump, and wherein said source of pressurized fuel comprises said fuel supply pump.

8. The invention as claimed in claim 1, including means for sensing engine speed, and means for controlling said variable orifice valve as a function of engine speed.

9. The invention as claimed in claim 5, including means for sensing engine speed, and means for controlling said pressure regulating valve as a function of engine speed.

10. A fuel injection system for selectively controlling the residual fuel pressure within a fuel injector and associated high pressure fuel conduits between injections to thereby selectively increase the fuel injection pressure produced by the injector, characterized by:

a fuel injection pump connected to a fuel supply;

at least one leakless fuel injector for periodically injecting fuel into an engine;

conduit means connecting said fuel injection pump with said fuel injector for delivery of fuel thereto;

a check valve disposed between said fuel injection pump and said conduit means, said check valve having a zero retraction volume to prevent fuel back flow to said injection pump between injections;

a leak-off passage for receiving leakage fuel from said injector;

pressure influencing means disposed within said injector for controlling fuel pressure within said leak-off passage, said pressure influencing means comprising a pressure amplifying variable orifice valve responsive to a regulated supply fuel pressure; and a pressure regulating valve connected with a source of fuel at a constant supply pressure, said regulating valve being controlled by engine manifold pressure to provide a regulated fuel pressure to said pressure influencing means which is substantially inversely proportional to engine load, whereby said pressure influencing means selectively raises the leak-off pressure in said leak-off passage and the residual fuel pressure within said injector between injections in inverse relation to engine load with a consequent increase in fuel injection pressure.

11. The invention as claimed in claim 10, including speed responsive means for controlling said regulating valve.

12. The invention as claimed in claim 10, wherein fuel passing through said variable orifice valve passes into said pressure regulated supply fuel.

13. The invention as claimed in claim 10, wherein said amplifying valve comprises a diaphragm valve, and wherein said regulated fuel pressure acts on said diaphragm to urge said valve toward a closed position.

14. A fuel injection system for selectively controlling the residual fuel pressure within a fuel injector and associated high pressure fuel conduits between injections to thereby selectively increase the fuel injection pressure produced by the injector, characterized by:

a fuel injection pump connected to a fuel supply;

at least one leakless fuel injector for periodically injecting fuel into an engine;

conduit means connecting said fuel injection pump with said fuel injector for delivery of fuel thereto;

a check valve disposed between said fuel injection pump and said conduit means, said check valve having a zero retraction volume to prevent fuel back flow to said injection pump between injections;

pressure influencing means connected with said conduit means for controlling fuel pressure within said conduit means and injector, said pressure influencing means comprising a pressure amplifying variable orifice valve responsive to a regulated supply fuel pressure; and a pressure regulating valve connected with a source of fuel at a constant supply pressure, said regulating valve being controlled by engine manifold pressure to provide a regulated fuel pressure to said pressure influencing means which is substantially inversely proportional to engine load, whereby said pressure influencing means selectively raises the residual fuel pressure within said injector and said conduit means between injections in inverse relation to engine load with a consequent increase in fuel injection pressure.

15. The invention as claimed in claim 14, including speed responsive means for controlling said regulating valve.

16. The invention as claimed in claim 14, wherein fuel passing through said variable orifice valve passes into said pressure regulated supply fuel.

17. The invention as claimed in claim 14, wherein said amplifying valve comprises a diaphragm valve, and wherein said regulated fuel pressure acts on said diaphragm to urge said valve toward a closed position.

* * * * *